US007753077B2

(12) United States Patent
Bertolasi et al.

(10) Patent No.: US 7,753,077 B2
(45) Date of Patent: Jul. 13, 2010

(54) HYBRID HYDRAULIC JOYSTICK FOR ELECTRICALLY OPERATING VALVES

(75) Inventors: Brian R. Bertolasi, Waukesha, WI (US); Joseph L. Pfaff, Wauwatosa, WI (US)

(73) Assignee: HUSCO International Inc., Waukesha, WI (US)

( * ) Notice: Subject to any disclaimer, the term of this patent is extended or adjusted under 35 U.S.C. 154(b) by 671 days.

(21) Appl. No.: 11/737,193

(22) Filed: Apr. 19, 2007

(65) Prior Publication Data

US 2008/0257090 A1 Oct. 23, 2008

(51) Int. Cl.
*F15B 13/02* (2006.01)

(52) U.S. Cl. ..... 137/636.2; 137/636; 137/557

(58) Field of Classification Search ..... 137/636, 137/636.1, 636.2, 558, 557
See application file for complete search history.

(56) References Cited

U.S. PATENT DOCUMENTS

| | | | | |
|---|---|---|---|---|
| 3,766,944 | A | 10/1973 | Distler | |
| 4,404,991 | A | 9/1983 | Cullen | |
| 5,140,320 | A | 8/1992 | Gerbier et al. | |
| 5,507,317 | A * | 4/1996 | Yonekubo et al. | 137/636.2 |
| 5,579,642 | A | 12/1996 | Wilke et al. | |
| 6,722,224 | B2 | 4/2004 | Nordstrom | |
| 2005/0247355 | A1 | 11/2005 | Ligneau | |

FOREIGN PATENT DOCUMENTS

| | | | |
|---|---|---|---|
| EP | 0366119 | A1 | 5/1990 |
| EP | 0 281 299 | A1 | 1/1998 |
| EP | 0821299 | A1 | 1/1998 |
| FR | 2801350 | A1 | 11/1999 |
| GB | 2 412 421 | A | 9/2005 |
| JP | 02117596 | | 2/1990 |

OTHER PUBLICATIONS

"Manual Hydraulic Pilots", product brochure HUSCO International, Inc., 1995.

* cited by examiner

*Primary Examiner*—Kevin L Lee
(74) *Attorney, Agent, or Firm*—George E Haas; Quarles & Brady LLP

(57) ABSTRACT

A user input device is provided for a hydraulic system that has a source of pressurized fluid and a tank. The user input device includes a body with a supply passage for receiving the pressurized fluid, a tank passage for connection to the tank, and a first chamber. A handle is pivotally attached to the body and operates one or more valves within the body. In a preferred embodiment, the handle can be pivoted independently about two orthogonal axis with separate pairs of valves operated by movement about each axis. In response to the position of the handle, each valve connects a separate chamber alternately to either the supply passage or the tank passage and different pressure sensor produces an electrical signal indicating a level of pressure in the chamber of each valve. Thus an electrical signal is produced from each valve to indicate motion of the handle.

20 Claims, 2 Drawing Sheets

HYBRID HYDRAULIC JOYSTICK FOR ELECTRICALLY OPERATING VALVES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a manual control device, such as joystick, which operate a valve to control the flow of hydraulic fluid to an actuator on a machine; and in particular to such control devices that provide electrical signals which are used to operate solenoid valves.

2. Description of the Related Art

Construction and agricultural equipment have working members which are driven by hydraulic actuators, such as cylinder and piston assemblies, for example. Each cylinder is divided into two internal chambers by the piston and selective application of hydraulic fluid under pressure to one or the other chamber produces movement of the piston in corresponding opposite directions.

Application of hydraulic fluid to and from the cylinder chambers often is controlled by a spool valve, such as the one described in U.S. Pat. No. 5,579,642. This type of hydraulic valve has an internal spool controls the fluid flow in response to being moved by a mechanical connection to an operator lever. Movement of the spool into various positions controls flow of fluid through two separate paths in the valve. The direction and amount of spool movement determines the direction and speed that the associated hydraulic actuator moves.

To reduce the number of valve control levers that a machine operator must manipulate, joysticks have been provided. A typical joystick can be pivoted about two orthogonal axes to designate operation of two separate hydraulic actuators of the machine. For example, movement about one axis may swing an excavator boom left and right, while movement about the other axis raises and lowers the boom. The original joysticks incorporated small valves, two valves associated with each axis. The joystick was normally biased into a centered position at which the output ports of all the valves opened to the tank line of the hydraulic system and actuator movement did not occur. Pivoting the joystick handle along one axis caused one valve in the associated pair to connect a hydraulic supply line to its outlet port, while the other valve of that pair remained opened to the tank line. That pair of joystick valves pilot-operated a main spool valve that metered fluid to and from the hydraulic actuator being controlled. Another pair of valves responded in an identical manner to pivoting the joystick about the other axis and pilot operated a different spool valve for another hydraulic actuator.

The load on the hydraulic actuator to being driven exerted a corresponding amount of fluid pressure back onto the main spool valve. Because the main spool valve was pilot-operated by the joystick valve, a dampened indication of the spool valve pressure was feedback to the joystick valve which exerted force on the joystick handle. Therefore, the machine operator received some feedback indicating the response of the hydraulic actuator to being driven by the fluid.

There is a present trend toward electrical control systems that use solenoid operated valves. This type of control simplifies the hydraulic plumbing as the main valves do not have to be located near an operator station, but can be located adjacent the actuator being controlled. This technological change also facilitates computerized control of the machine functions. For electrical control, the joystick that incorporated hydraulic valves is replaced with an electrical joystick which produces electrical signals indicating the amount of handle motion along each axis. For example, a separate potentiometer is driven by motion along each joystick axis. Those electrical signals are used to derive electric currents for driving solenoids that operated the main valves to control the fluid flow to the hydraulic actuators.

Machine operators objected to the different feel of the electrical joystick which did not provide the dampened feedback to which the operators were accustomed. In addition, electrical joysticks did not hold up well in the harsh operating conditions encountered by construction and other types of machinery. The electrical joysticks had a relatively short life, as compared with their hydraulic counterparts.

Therefore, it is desirable to provide a joystick that produces electrical control signals, but has the feel and reliability of a hydraulic joystick.

SUMMARY OF THE INVENTION

A joystick for a hydraulic system includes a body with a first chamber, a supply passage that receives the pressurized fluid from a source, a tank passage that is connected to the fluid reservoir of the hydraulic system. A handle is pivotally mounted on the body. A first valve in the body is operable by the handle to connect the first chamber selectively to the supply passage and the tank passage. A first pressure sensor produces an electrical signal indicating a level of pressure in the first chamber.

In the preferred embodiment, the handle pivots about two orthogonal axes with respect to the body. In this case, the first valve and a second valve respond to motion of the handle about one axis, and a third valve and a fourth valve respond to motion of the handle about the other axis. Each of the first, second, third, and fourth valves selectively connect first, second, third, and fourth chambers in the body to the supply passage and the tank passage depending on a direction of movement of the handle about the two orthogonal axes. First, second, third, and fourth pressure sensors produce electrical signals indicating pressure levels in the first, second, third, and fourth chambers, respectively, thereby providing a set of four electrical signals indicating the direction and degree of handle movement.

An aspect of the present invention is that for each valve there is a valve bore in the body and connected to one of the chambers and into which the supply passage and the tank passage open. Every valve also includes valve element that slides within the respective valve bore in response to the handle pivoting. Each valve element has a first position in which the tank passage is connected to the associated chamber and a second position in which the supply passage is connected to the associated chamber.

DETAILED DESCRIPTION OF THE INVENTION

Figure 1:
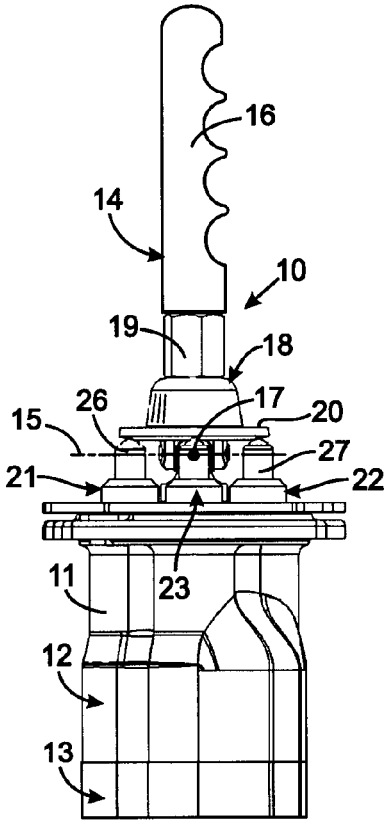
FIG. 1 is a side elevational view of a joystick according to the present invention.

With initial reference to FIG. 1, a hybrid hydro-electrical joystick 10 is provided as an input device by which a human operator is able to control a hydraulic system on a machine. The joystick 10 comprises a valve assembly 12 to which an electronics module 13 is attached by machine screws or other suitable means. An operator handle 14 is pivotally mounted on the body 11 of the valve assembly 12 in a manner that allows the handle to be independently pivoted about two orthogonal axes 15 and 17 with respect to the valve assembly. Any of several well known couplings, such as gimbals or a ball and socket combination, can be employed to provide that dual axis, pivotable connection. The handle 14 includes a grip 16 is threaded into a coupling 19 that also attaches an inverted cup-like valve actuator 18 which has a flange 20.

Figure 2:
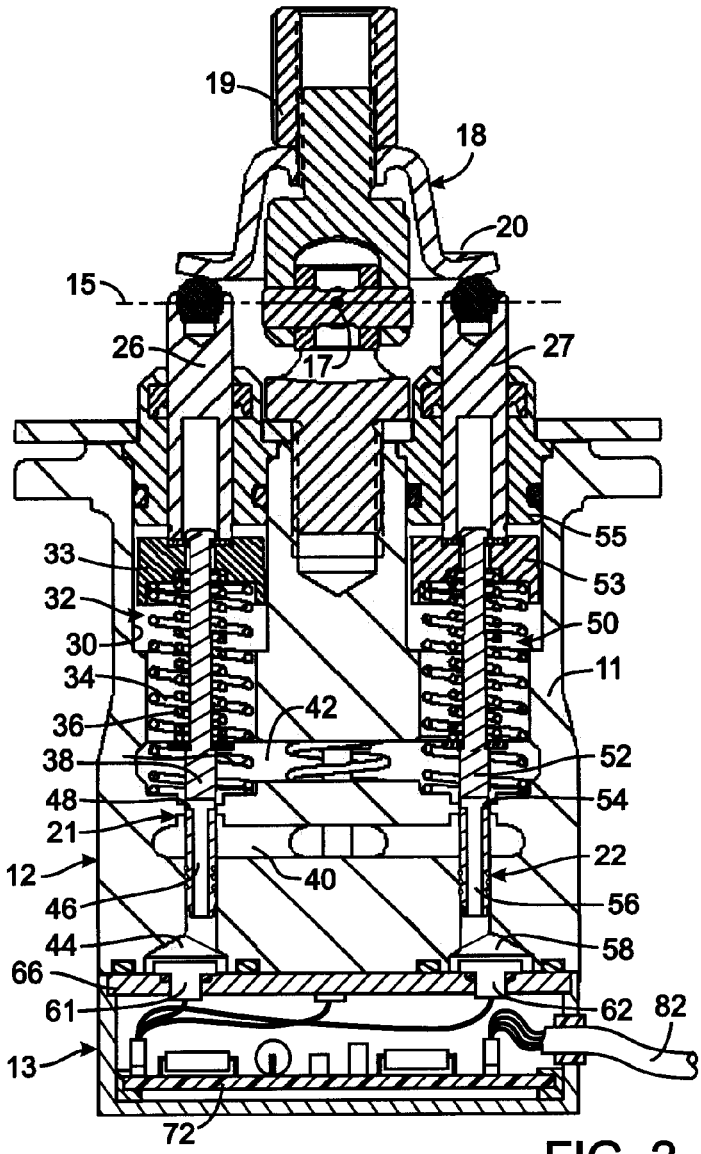
FIG. 2 is a vertical cross sectional view through the joystick in FIG. 1 with a handle grip removed.
Figure 3:
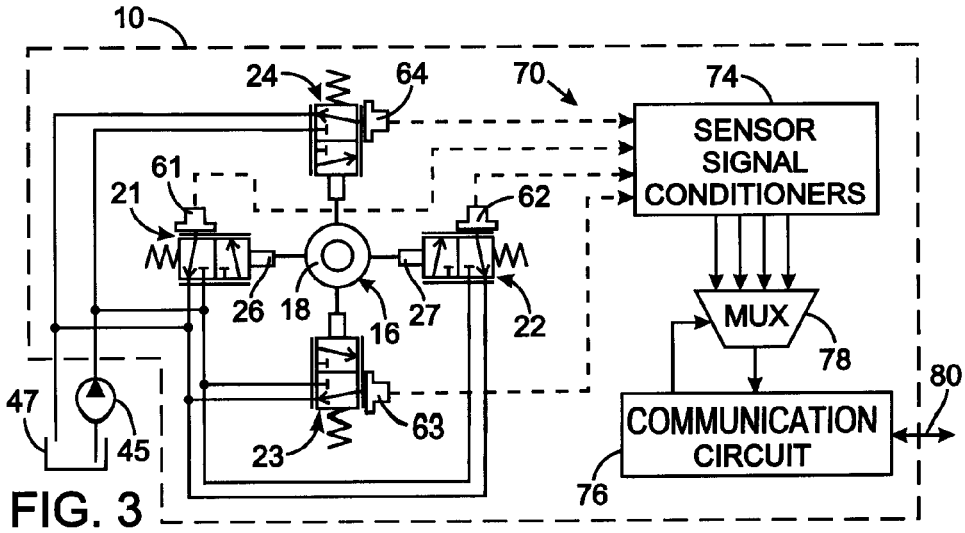
FIG. 3 is schematic diagram of the hydraulic and electrical circuits of the joystick.

With additional reference to FIG. 2, the flange 20 of the valve actuator 18 operate four valves 21, 22, 23, and 24 within the valve assembly 12. The first and second valves 21 and 22 are arranged in the valve assembly 12 along one orthogonal axis 15, while the third and fourth valves 23 and 24 are arranged along the other orthogonal axis 17 (as schematically depicted in FIG. 3). FIG. 2 shows the details and relationship of the first and second valves 21 and 22 with the understanding that the third and fourth hydraulic valves 23 and 24 have identical construction but are oriented orthogonally to the cross section plane of the drawings. The joystick's first valve 21 has a first actuator shaft 26 with an end that projects out of the valve assembly 12 and abuts the actuator flange 20. The first actuator shaft 26 extends through a first valve bore 30 in the valve assembly 12 and has an opposite end abutting a retainer 33 of a first spring assembly 32. The first spring assembly 32 comprises a first spring 34 held between the retainer 33 and the body 11 of the valve assembly 12, thereby biasing the first actuator shaft 26 outward from the valve assembly body. The spring assembly 32 also includes a second spring 36 located coaxially within the first spring 34 that abuts the retainer 33 and biases a first valve element 38 away from the first actuator shaft 26 within the first valve bore 30.

The first valve element 38 selectively controls the flow of fluid between a first chamber 44 and either a supply passage 40 or a tank passage 42 in the body 11. Thus the first chamber 44 forms an outlet of the first valve 21 and opens only into the first valve bore 30. The supply passage 40 is connected to a source of pressurized fluid, such as the outlet of a pump 45 of a machine to which the joystick 10 is mounted (see FIG. 3). The tank passage 42 is connected to the tank 47 of the machine's hydraulic system. The first valve element 38 has a passage 46 that extends from an end that faces the first chamber 44 at one end of the first valve bore 30 to openings 48 in the sides of the valve element. In the normal state of the first valve 21, when the joystick handle 14 is in the centered position illustrated in FIG. 2, the flow passage side openings 48 communicate with the tank passage 42. As a consequence in the normal state, the first chamber 44 is connected to the tank 47 of the hydraulic system. The first chamber 44 and similar chamber for the other valves 22, 23, and 24 may be an end section of the associated valve bore or may be spaced from that valve bore and connected thereto by a fluid passageway. Those chambers form an outlet of the respective valves 22, 23, and 24.

The second valve 22 has an identical construction to that just described with respect to the first valve 21 and is located within the valve assembly 12 along the same first axis 15 on the opposite side of the handle 14. It should be understood that although the first and second valves 21 and 22 are located along the first axis 15, they respond to the handle 14 being pivoted about the second axis 17 that extends into and out of the plane of the drawing. Likewise the third and fourth valves 23 and 24, located along the second axis 17, respond to the handle 14 being pivoted about the first axis 15.

When the machine operator pivots the handle 14 to the left about the second axis 17 in FIGS. 1 and 2, the flange 20 of the valve actuator 18 pushes the first actuator shaft 26 of the first valve 21 into the valve assembly 12. In turn the first actuator shaft 26 pushes the first valve element 38 through the valve bore 30 toward the first chamber 44. This motion causes the openings 48 in the sides of the first valve element 38 to communicate with the supply passage 40, thereby providing a path for pressurized fluid to flow into the first chamber 44 increasing the pressure therein. That leftward pivoting motion also moves the opposite right side of the actuator flange 20 upward. In response, the force of the second spring assembly 50 for the second valve 22 causes a second actuator shaft 27 to follow partially the right side of the actuator flange 20 upward causing the second valve element 52 also to move upward until the retainer 53 abuts the bore plug 55. During that motion of the second valve element 52, the side openings 54 of the internal passage 56 continuously open into the tank passage 42 so that the pressure in the second chamber 58 remains at the relatively low level of the tank 47 of the hydraulic system.

Therefore, pivoting the handle 14 leftward applies a greater pressure from the supply passage 40 to the first chamber 44. As a consequence, the pressure in the first chamber 44 increases while the pressure in the second chamber 58 remains at a low level. As will be described, the pressures in each of these chambers 44 and 58 are measured by separate first and second pressure sensors 61 and 62, respectively. The first and second pressure sensors 61 and 62 are mounted on a plate 66 that extends across the bottom surface of the valve assembly 12 through which the first and second chambers 44 and 58 open. The combination of that plate 66 and the pressure sensors 61 and 62 close off the first and second chambers 44 and 58 and annular seals prevent fluid leakage there between. Therefore the only openings into the first and second chambers 44 and 58 are through the respective first and second valves 21 and 22. The plate 66 is held in place by the attachment of the electronics module 13 onto the valve assembly 12.

Should the machine operator pivot the handle 14 to the right in FIGS. 1 and 2, the actions of the first and second valves 21 and 22 are reversed. Specifically the actuator flange 20 pushes the second actuator shaft 27 and associated second valve element 52 downward in the valve assembly 12, so that valve element provides a fluid path between the supply passage 40 and the second chamber 58. This opposite pivoting action also causes the first actuator shaft 26 and the first valve element 38 of the first valve 21 to move upward, however the first chamber 44 remains connected by the first valve element to the tank passage 42. As a consequence, the pressure within the second chamber 58 increases due to coupling to the supply passage 40 and the pressure within the first chamber 44 is maintained at a relatively low level. These pressure levels a detected by the first and second pressure sensors 61 and 62.

Pivoting the handle 14 into or out of the plane of the FIG. 2, i.e. about the first axis 15, operates the third and fourth valves 23 and 24 in identical manners to that described with respect to the first and second valves 21 and 22. The pressures produced in the output chambers for the third and fourth valves 23 and 24 are measured by third and fourth pressure sensors 63 and 64 (see FIG. 3).

With reference to FIG. 3, the first and second pressure sensors 61 and 62 and another pair of third and fourth pressure sensors 63 and 64 associated with the third and fourth valves 23 and 24, respectively, are part of an electrical circuit 70 in the electronics module 13 of the joystick 10. That circuitry is mounted on a printed circuit board 72 to which wires from each of the four pressure sensors 61-64 connect. The four pressure sensors 61-64 are connected to inputs of a set of sensor signal conditioners 74. In particular, a separate signal conditioning circuit amplifies and converts each sensor output signal into a signal that is compatible with a communication circuit 76 within the joystick 10. The resultant four conditioned sensor signals are applied to a four-to-one multiplexer 78 which selectively applies one of those signals to an input of the communication circuit 76. The communication circuit 76 interfaces the joystick 10 with a communication network 80 for the machine. For example, construction vehicles employ a Controller Area Network (CAN) that utilizes a protocol defined by the ISO 11898 standard promulgated by the International Organization for Standardization in Geneva, Switzerland.

The joystick communication circuit 76 sends control signals to the multiplexer 78 which responds by sequentially applying each of the four conditioned pressure signals to the input of the communications circuit. Each of those pressure signals is digitized by the communication circuit 76 and transmitted serially over the communication network 80. As illustrated in FIG. 2, the conductors of the communication network 80 are part of a cable 82 extending out of the electronics module 13 of the joystick 10. That cable 82 also conducts electrical power to the circuitry of the joystick.

Because the handle 14 of the joystick 10 operates a set of hydraulic valves 21-24 that control the application of pressurized fluid, the joystick provides dampened feedback to the operator in a manner similar to previous hydraulic joysticks. Therefore, the present joystick has a feel to the operator that corresponds closely to conventional hydraulic controls to which machine operators are accustomed.

Figure 4:
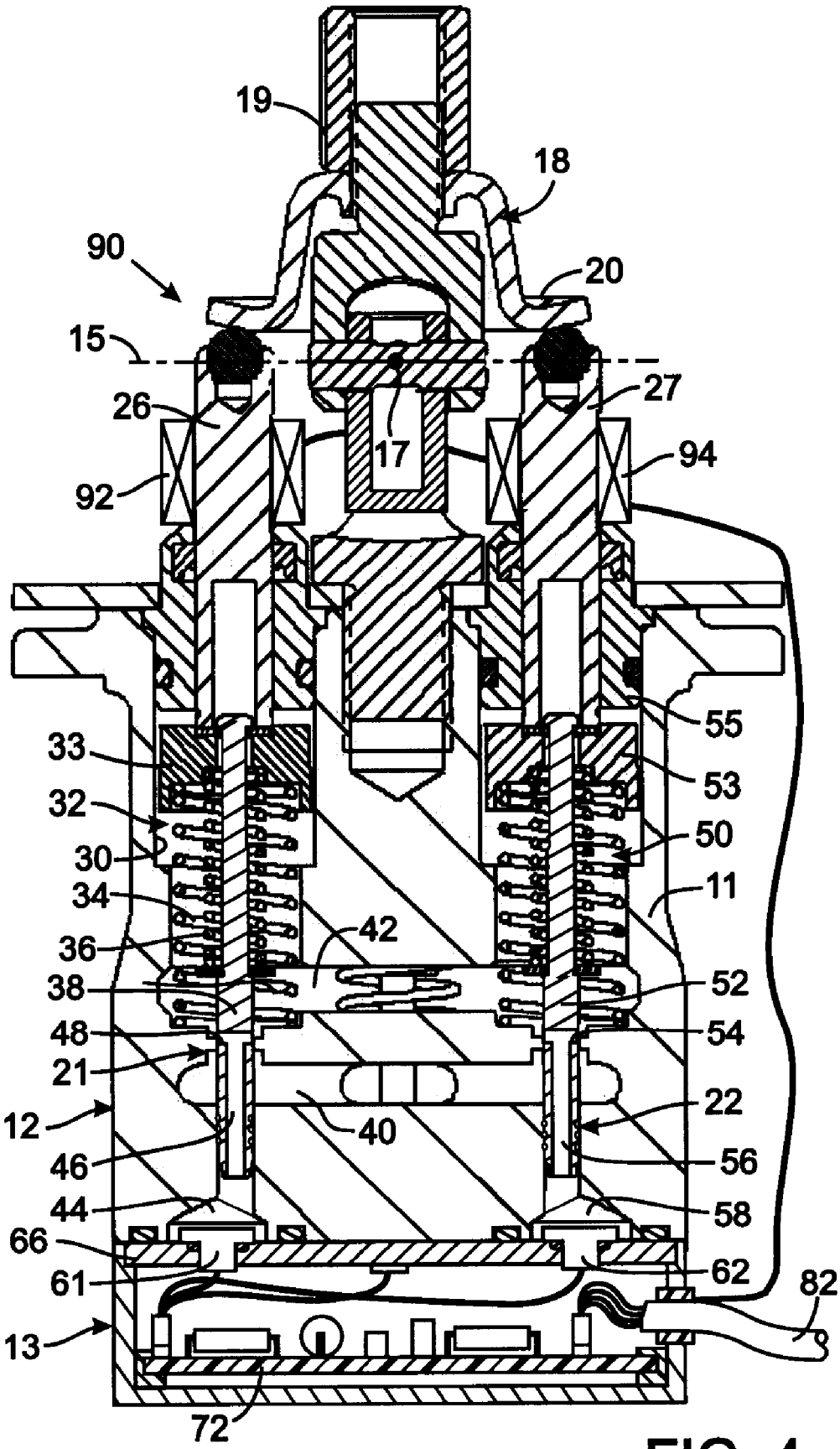
FIG. 4 is a vertical cross sectional view through another embodiment of a joystick similar to FIG. 2 with electromagnetic tactile feedback.

With reference to FIG. 4, a second joystick 90 is similar to the joystick 10 previously described, with identical components being assigned the same reference numerals. The second joystick 90 has elongated first and second actuator shafts 26 and 27. A separate electromagnet coil 92 and 94 is placed around each of the first and second actuator shafts 26 and 27, respectively. Another pair of electromagnet coils (not shown) are placed around the actuator shafts for the other two valve in the second joystick 90. The electromagnet coils 92 and 94 are connected to the electrical circuit 70 that is mounted on a printed circuit board 72 and are activated by that circuit in response to load pressures sensed at the actuators being controllers by the joystick. The sensed pressure signals are sent to the electrical circuit 70 via the communication network 80. Activation of the electromagnet coil 92 and 94 creates magnetic fields that exert forces on the actuator shafts 26 and 27 in proportion to the actuator load and which provide resistance to joystick motion the also corresponds to the magnitude of the actuator load. This provides tactile feedback to the operator much like conventional totally hydraulic joysticks.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A joystick for a hydraulic system having a source of pressurized fluid and a tank, said joystick comprising:

a body having a first chamber, a supply passage for receiving the pressurized fluid from the source, and a tank passage for connection to the tank;

a handle pivotally connected to the body;

a first valve in the body and operable by the handle to connect the first chamber selectively to the supply passage and the tank passage; and a first pressure sensor mounted to the body for producing an electrical signal indicating a level of pressure in the first chamber.

2. The joystick as recited in claim 1 wherein:

the body has a valve bore into which the supply passage, the tank passage and the first chamber communicate; and the first valve includes a valve element received within the valve bore and moveable therein in response to movement of the handle.

3. The joystick as recited in claim 2 wherein the valve element has a first position in the valve bore in which a path is formed between the tank passage and the first chamber, and has a second position in the valve bore in which another path is formed between the supply passage and the first chamber.

4. The joystick as recited in claim 3 further comprising a spring arrangement biasing the valve element into the first position.

5. The joystick as recited in claim 1 wherein the first chamber has only a single opening, which single opening is through the first valve.

6. The joystick as recited in claim 1 further comprising:

a second chamber in the body;

a second valve in the body and operable by the handle to connect the second chamber selectively to the supply passage and the tank passage; and a second pressure sensor mounted to the body for producing an electrical signal indicating a level of pressure in the second chamber.

7. The joystick as recited in claim 6 wherein the first chamber has only a single opening, which single opening is through the first valve; and the second chamber has only one opening, which one opening is through the second valve.

8. The joystick as recited in claim 1 further comprising a communication circuit within the body and connected to the first pressure sensor for transmitting an indication of the level of pressure in the first chamber over a computer network.

9. The joystick as recited in claim 1 further comprising an electromagnetic magnetically coupled to the valve wherein a magnetic field produced by the electromagnetic provides resistance to motion of the joystick handle.

10. A joystick for a hydraulic system having a source of pressurized fluid and a tank, said joystick comprising:

a handle pivotable about a first axis and a second axis orthogonally oriented with respect to each other;

a first valve having a first outlet and being operable by the handle pivoting about the first axis to connect the first outlet selectively to the source and the tank;

a second valve having a second outlet and being operable by the handle pivoting about the second axis to connect the second outlet selectively to the source and the tank;

a first pressure sensor that produces a first electrical signal indicating a level of pressure in the first outlet; and a second pressure sensor that produces a second electrical signal indicating a level of pressure in the second outlet.

11. The joystick as recited in claim 10 further comprising:

a third valve having a third outlet and being operable by the handle pivoting about the first axis to connect the third outlet selectively to the source and the tank;

a fourth valve having a fourth outlet and being operable by the handle pivoting about the second axis to connect the fourth outlet selectively to the source and the tank;

a third pressure sensor that produces a third electrical signal indicating a level of pressure in the third outlet; and a fourth pressure sensor that produces a fourth electrical signal indicating a level of pressure in the fourth outlet.

12. The joystick as recited in claim 11 wherein each of the first valve, the second valve, the third valve and the fourth valve comprises a valve element moveably received within a separate valve bore and slideable therein in response to movement of the handle, the valve element having a first position in which a path is formed between the tank and the respective outlet, and having a second position in which another path is formed between the source and the respective outlet.

13. The joystick as recited in claim 12 wherein each of the first valve, the second valve, the third valve and the fourth valve further comprises a spring arrangement biasing the respective valve element into the first position.

14. The joystick as recited in claim 10 further comprising a communication circuit and connected to the first and second pressure sensors for transmitting indications of the level of pressure in the first outlet and in the second outlet over a computer network.

15. The joystick as recited in claim 10 further comprising a separate electromagnetic magnetically coupled to each of the first and second valve, wherein a magnetic field produced by each electromagnetic provides resistance to motion of the joystick handle.

16. A joystick for a hydraulic system having a source of pressurized fluid and a tank, said joystick comprising:

a body having a first valve bore connected to a first chamber, a second valve bore connected to a second chamber, a third valve bore connected to a third chamber, and a fourth valve bore connected to a fourth chamber, the body further including a supply passage for receiving the pressurized fluid from the source and communicating with each of the first, second, third, and fourth chambers, and including a tank passage for connection to the tank and communicating with each of the first, second, third, and fourth chambers;

a handle pivotally connected to the body and pivotable about a first axis and a second axis orthogonally oriented with respect to each other;

a first valve element slideable in the first valve bore in response to the handle pivoting about the first axis, and having a first position in which the tank passage is connected to the first chamber and a second position in which the supply passage is connected to the first chamber;

a second valve element slideable in the second valve bore in response to the handle pivoting about the first axis, and having a first position in which the tank passage is connected to the second chamber and a second position in which the supply passage is connected to the second chamber;

a third valve element slideable in the third valve bore in response to the handle pivoting about the second axis, and having a first position in which the tank passage is connected to the third chamber and a second position in which the supply passage is connected to the third chamber;

a fourth valve element slideable in the fourth valve bore in response to the handle pivoting about the second axis, and having a first position in which the tank passage is connected to the fourth chamber and a second position in which the supply passage is connected to the fourth chamber;

a first pressure sensor that produces a first electrical signal indicating a level of pressure in the first chamber;

a second pressure sensor that produces a second electrical signal indicating a level of pressure in the second chamber;

a third pressure sensor that produces a third electrical signal indicating a level of pressure in the third chamber; and a fourth pressure sensor that produces a fourth electrical signal indicating a level of pressure in the fourth chamber.

17. The joystick as recited in claim 16 wherein each of the first, second, third, and fourth valve elements is biased toward the first state by a separate spring arrangement.

18. The joystick as recited in claim 16 wherein the only opening into the first chamber is through the first valve bore, the only opening into the second chamber is through the second valve bore, the only opening into the third chamber is through the third valve bore, and the only opening into the fourth chamber is through the fourth valve bore.

19. The joystick as recited in claim 16 further comprising a communication circuit within the body and connected to the first, second, third, and fourth pressure sensors for transmitting indications of the level of pressure in the first, second, third, and fourth chambers over a computer network.

20. The joystick as recited in claim 16 further comprising a separate electromagnetic magnetically coupled to each of the first, second, third and fourth valve, wherein a magnetic field produced by each electromagnetic provides resistance to motion of the joystick handle.

* * * * *